US011537057B2

(12) United States Patent
Sawada et al.

(10) Patent No.: US 11,537,057 B2
(45) Date of Patent: Dec. 27, 2022

(54) TONER, TONER ACCOMMODATING UNIT, IMAGE FORMING APPARATUS, AND IMAGE FORMING METHOD

(71) Applicant: RICOH COMPANY, LTD., Tokyo (JP)

(72) Inventors: Toyoshi Sawada, Shizuoka (JP); Kazumi Suzuki, Shizuoka (JP); Katsunori Kurose, Shizuoka (JP); Akihiro Kaneko, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 189 days.

(21) Appl. No.: 16/841,731

(22) Filed: Apr. 7, 2020

(65) Prior Publication Data

US 2020/0333720 A1 Oct. 22, 2020

(30) Foreign Application Priority Data

Apr. 16, 2019 (JP) ..... JP2019-077945

(51) Int. Cl.

| | |
|---|---|
| ***G03G 9/087*** | (2006.01) |
| ***G03G 15/20*** | (2006.01) |
| ***G03G 15/16*** | (2006.01) |
| ***G03G 15/08*** | (2006.01) |

(52) U.S. Cl.

CPC ..... *G03G 9/08791* (2013.01); *G03G 9/08782* (2013.01); *G03G 15/0822* (2013.01); *G03G 15/1625* (2013.01); *G03G 15/1635* (2013.01); *G03G 15/20* (2013.01)

(58) Field of Classification Search

CPC ..... G03G 9/08704; G03G 9/08782

See application file for complete search history.

(56) References Cited

U.S. PATENT DOCUMENTS

| | | | | |
|---|---|---|---|---|
| 2010/0279220 | A1* | 11/2010 | Nakamura | G03G 9/0821 430/97 |
| 2012/0082926 | A1 | 4/2012 | Suzuki et al. | |
| 2012/0288791 | A1* | 11/2012 | Sakashita | G03G 9/08795 430/108.4 |
| 2013/0017480 | A1 | 1/2013 | Suzuki et al. | |
| 2013/0330522 | A1 | 12/2013 | Suzuki et al. | |
| 2013/0344430 | A1* | 12/2013 | Terauchi | G03G 9/08733 430/109.31 |
| 2014/0272696 | A1 | 9/2014 | Yamashita et al. | |
| 2015/0248074 | A1 | 9/2015 | Suzuki et al. | |
| 2015/0253685 | A1 | 9/2015 | Suzuki et al. | |
| 2019/0196349 | A1 | 6/2019 | Sawada et al. | |

(Continued)

FOREIGN PATENT DOCUMENTS

| | | |
|---|---|---|
| JP | 11 -249338 | 9/1999 |
| JP | 2003-098754 | 4/2003 |

(Continued)

OTHER PUBLICATIONS

U.S. Appl. No. 16/604,058 filed Apr. 6, 2018, Toyoshi Sawada, et al.

*Primary Examiner* — Peter L Vajda

(74) *Attorney, Agent, or Firm* — Grüneberg and Myers, PLLC

(57) ABSTRACT

A toner is provided. The toner comprises a maleic-acid-modified polyolefin having a polypropylene block in a main chain and having a weight average molecular weight of 60,000 or more.

15 Claims, 3 Drawing Sheets

(56) References Cited

U.S. PATENT DOCUMENTS

| | | | |
|---|---|---|---|
| 2019/0196362 | A1 | 6/2019 | Tanaka et al. |
| 2019/0204760 | A1 | 7/2019 | Suzuki et al. |
| 2020/0033745 | A1 | 1/2020 | Sawada et al. |

FOREIGN PATENT DOCUMENTS

| | | |
|---|---|---|
| JP | 2003-255588 | 9/2003 |
| JP | 2013-044786 | 3/2013 |

* cited by examiner

TONER, TONER ACCOMMODATING UNIT, IMAGE FORMING APPARATUS, AND IMAGE FORMING METHOD

CROSS-REFERENCE TO RELATED APPLICATIONS

This patent application is based on and claims priority pursuant to 35 U.S.C. § 119(a) to Japanese Patent Application No. 2019-077945, filed on Apr. 16, 2019, in the Japan Patent Office, the entire disclosure of which is hereby incorporated by reference herein.

BACKGROUND

Technical Field

The present disclosure relates to a toner, a toner accommodating unit, an image forming apparatus, and an image forming method.

Description of the Related Art

An electrophotographic method forms a visible image by developing an electrostatic latent image with a developer. Specifically, an electrostatic latent image is formed on an electrostatic latent image bearer (also referred to as "photoconductor") containing a photoconductive substance. The electrostatic latent image is developed with a developer containing toner to form a toner image, then the toner image is transferred onto a recording medium such as a paper sheet and fixed thereon by heat and pressure to form a fixed image.

To form a full-color image by the electrophotographic method, a toner set including black toner in combination with cyan, magenta, and yellow toners, which are toners of three process colors, is generally used.

In recent years, as electrophotographic color image forming apparatuses have become widespread, the uses of the printed products thereof have been diversified. Particularly in the field of printing on packaging materials, there is an increasing need for an electrophotographic printing method that makes it possible to make print on packaging materials which cannot make print with conventional electrophotographic toners designed to be printed on paper media. Specifically, there is a growing need for printing technique on plastic film media frequently used for food packaging materials. It has been conventionally confirmed that, when toner is improved in fixability by changing thermal characteristics at the expense of releasability, undesirable phenomena such as hot offset and sheet wrapping around the fixing roller ("waste sheet jam") occur. A toner having excellent fixability on plastic film media and excellent releasability has not been proposed yet.

SUMMARY

In accordance with some embodiments of the present invention, a toner is provided. The toner comprises a maleic-acid-modified polyolefin having a polypropylene block in a main chain and having a weight average molecular weight of 60,000 or more.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
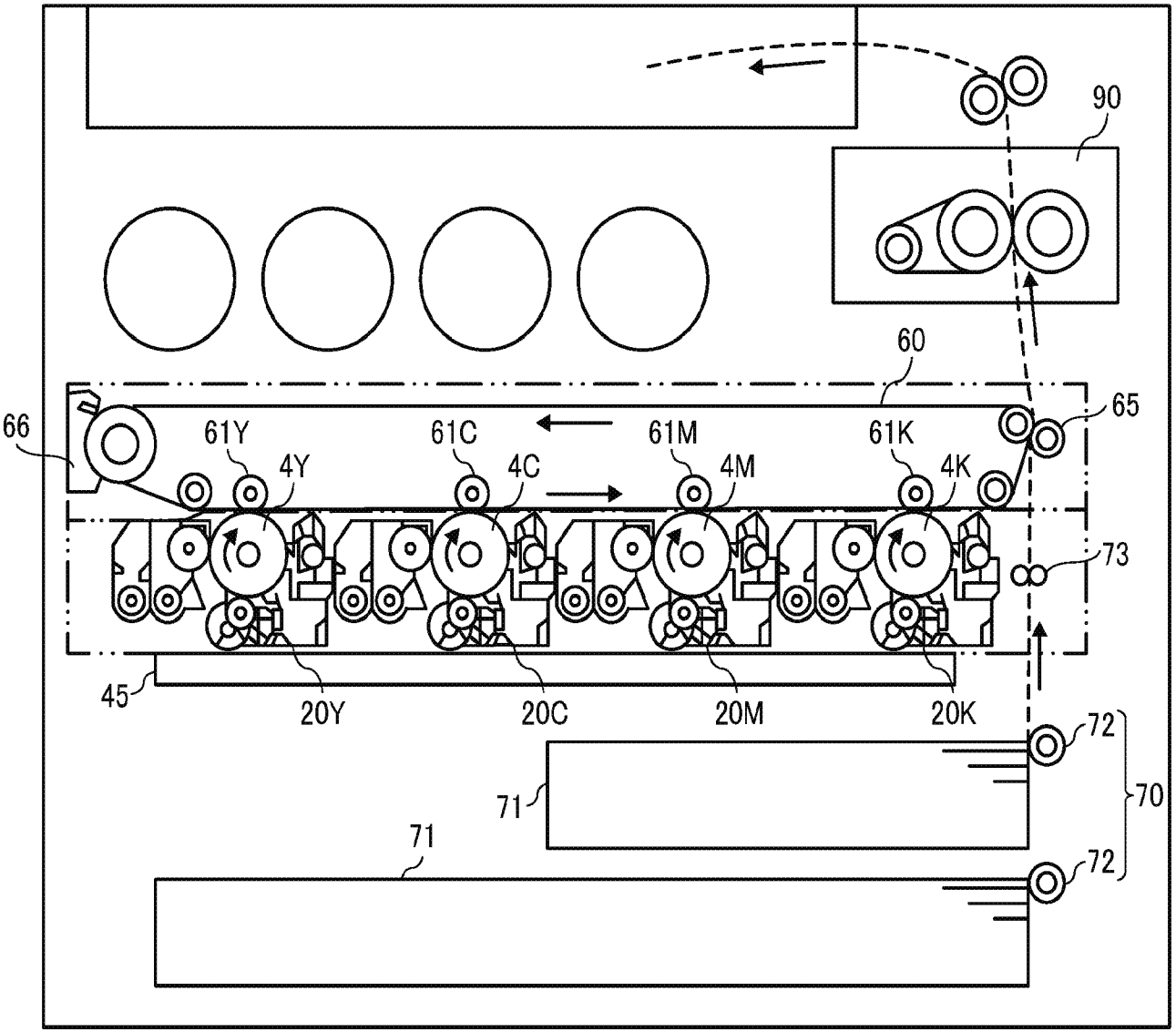
FIG. 1 is a schematic diagram illustrating an image forming apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, a toner is provided that has excellent releasability and is fixable on plastic films on which conventional toner is unfixable.

The toner according to an embodiment of the present invention contains a maleic-acid-modified polyolefin having a polypropylene block in the main chain. The maleic-acid-modified polyolefin having a polypropylene block in the main chain has a weight average molecular weight of 60,000 or more.

Hereinafter, a toner, a developer, and an image forming apparatus according to some embodiments of the present invention are described with reference to the drawings. Incidentally, it is to be noted that the following embodiments are not limiting the present invention and any deletion, addition, modification, change, etc. can be made within a scope in which person skilled in the art can conceive including other embodiments, and any of which is included within the scope of the present invention as long as the effect and feature of the present invention are demonstrated.

Structure, ½ Outflow Temperature, Molecular Weight, Acid Modification Rate, and Amount of Maleic-acid-modified Polyolefin Having Polypropylene Block in Main Chain Preferably, the toner of the present disclosure contains a polyolefin having a main chain having a polypropylene block, whose terminal or side chain is modified with maleic acid, as a binder resin. The inventors of the present invention have found that such a toner has significantly improved in fixability on plastic films. It is sufficient that the main chain has a polypropylene block. Preferably, the main chain is a block copolymer having at least one of polyethylene block and polybutene block in addition to the polypropylene block.

The proportion of the maleic-acid-modified polyolefin having a polypropylene block in the main chain in the toner is preferably from 0.1 to 8.0% by mass. When the proportion is 0.1% by mass or more, fixability of the toner on plastic films is sufficient. When the proportion is 8.0% by mass or less, hot offset does not occur at the time of fixing of the toner. In addition, waste sheet jam does not occur, caused when the toner and the fixing roller (or fixing belt) are inseparable from each other.

The maleic-acid-modified polyolefin having a polypropylene block in the main chain preferably has a ½ outflow temperature of from 95 to 150 degrees C. When the ½ outflow temperature is 95 degrees C. or higher and when the ½ outflow temperature is 150 degrees C. or lower, fixability of the toner on plastic films is sufficient.

The maleic-acid-modified polyolefin having a polypropylene block in the main chain has a weight average molecular weight of 60,000 or more. When the weight average molecular weight is less than 60,000, the maleic-acid-modified polyolefin functions as a release agent and does not exert fixability on plastic films. Preferably, the weight average molecular weight of the maleic-acid-modified polyolefin having a polypropylene block in the main chain is 80,000 or more, more preferably in the range of from 80,000 to 100,000. When the weight average molecular weight is 100,000 or less, the ½ outflow temperature and melt viscosity do not become too high, so that fixability on plastic films is sufficient.

Preferably, the maleic-acid-modified polyolefin having a polypropylene block in the main chain has a maleic acid modification rate of from 0.5% to 8.0% by mass. When the maleic acid modification rate is within this range, at the time when the toner is melting, the maleic-acid-modified polyolefin having a polypropylene block in the main chain exudes to the interface between the film and the toner, achieving good fixability.

Type and Amount of Wax

The toner of the present disclosure may include a wax. The type of the wax is not particularly limited and can be suitably selected to suit to a particular application. One type of wax may be used alone, or two or more types of waxes may be used in combination. Examples thereof include, but are not limited to, release agents such as aliphatic hydrocarbons such as liquid paraffin, micro-crystalline wax, natural paraffin, synthetic paraffin, and polyolefin wax, and partial oxides, fluorides, and chlorides thereof; animal oils such as beef tallow and fish oil; vegetable oils such as coconut oil, soybean oil, rapeseed oil, rice bran wax, and carnauba wax; higher aliphatic alcohols and higher fatty acids such as montan wax; fatty acid amides and fatty acid bisamides; metal soaps such as zinc stearate, calcium stearate, magnesium stearate, aluminum stearate, zinc oleate, zinc palmitate, magnesium palmitate, zinc myristate, zinc laurate, and zinc behenate; fatty acid esters; and polyvinylidene fluoride. In particular, ester waxes, including fatty acid esters, are preferred. When the toner contains the maleic-acid-modified polyolefin having a polypropylene block in the main chain in too large amounts, the toner and the fixing roller (or fixing belt) are inseparable from each other at the time of fixing the toner, and waste sheet jam may occur. The inventors of the present invention have found that this undesirable phenomenon is prevented when the toner contains an ester wax as a release agent. Further, the inventors have found that the maleic-acid-modified polyolefin having a polypropylene block in the main chain has an effect of finely dispersing the ester wax.

The proportion of the wax in the toner is preferably from 0.1% to 8.0% by mass. When the proportion is 0.1% by mass or more, the toner and the fixing roller (or fixing belt) are separable from each other at the time of fixing the toner, and waste sheet jam does not occur. When the proportion is 8.0% by mass or less fixability of the toner on plastic films is sufficient.

½ Outflow Temperature of Toner

The ½ outflow temperature of the toner of the present disclosure is desirably low as long as heat-resistant storage stability and hot offset resistance of the toner do not deteriorate, and is preferably from 100 to 115 degrees C. When the ½ outflow temperature is 100 degrees C. or higher, heat-resistant storage stability and hot offset resistance of the toner are improved. When the ½ outflow temperature is 115 degrees C. or lower, the toner sufficiently melts when being fixed on a plastic film to increase the contact area, providing sufficient fixability of the toner on plastic films.

The ½ outflow temperature of the toner can be adjusted by the binder resin of the toner.

Component Analysis by GC-MS

Confirmation of the presence of the maleic-acid-modified polyolefin having a polypropylene block in the main chain in the toner and quantification thereof can be performed by the following procedures, instruments, and conditions.

[Specimen Treatment]

The toner is dispersed in chloroform and stirred overnight. Subsequently, the resultant dispersion liquid is centrifuged, and only the supernatant is collected. The collected supernatant is evaporated to dryness and subjected to composition analysis by GC-MS. When the other components such as a binder resin and a release agent are dissolved in this dispersion liquid, the analysis is performed using a peak specific to the maleic-acid-modified polyolefin having a polypropylene block in the main chain.

A specimen is prepared by dropping about 1 μL of a methylating agent (20% methanol solution of tetramethylammonium hydroxide (TMAH)) into about 1 mg of a sample.

[Measurement]

Pyrolysis-gas chromatography-mass spectrometer (Py-GCMS)

Analyzer: QP2010 available from Shimadzu Corporation

Heating furnace: Py2020D available from Frontier Laboratories Ltd.

Heating temperature: 320 degrees C.

Column: Ultra ALLOY-5, L=30 m, ID=0.25 mm, Film=0.25 μm

Column temperature: 50 degrees C. (held for 1 minute) →temperature rise (at 10 degrees C./min)→340 degrees C. (held for 7 minutes)

Split ratio: 1:100

Column flow rate: 1.0 ml/min

Ionization method: EI method (70 eV)

Measurement mode: Scan mode

Search data: NIST 20 MASS SPECTRAL LIB. Component Analysis by Nuclear Magnetic Resonance (NMR)

Confirmation of the presence of the maleic-acid-modified polyolefin having a polypropylene block in the main chain in the toner and quantification thereof can be performed by the following procedures, instruments, and conditions.

[Specimen Preparation]

The toner is dispersed in chloroform and stirred overnight. Subsequently, the resultant dispersion liquid is centrifuged, and only the supernatant is collected. The collected supernatant is evaporated to dryness and subjected to composition analysis by NMR. When the other components such as a binder resin and a release agent are dissolved in this dispersion liquid, the analysis is performed using a peak specific to the maleic-acid-modified polyolefin having a polypropylene block in the main chain.

(1) For 1H-NMR

To 1 mL of d8-toluene, 100 mg of a sample are added and heated with a dryer to dissolve therein, thus preparing a specimen for 1H-NMR measurement.

(2) For 13C-NMR

To 1 mL of deuterated 1,2-dichlorotoluene, 100 mg of a sample are added and heated with a dryer to dissolve therein, thus preparing a specimen for 13C-NMR measurement.

[Analysis Instruments and Measurement Conditions]

NMR equipment: ECX-500 manufactured by JEOL Ltd. (1) Measurement nucleus=1H (500 MHz), measurement pulse file=single pulse dec.jxp (1H), 45 deg. C pulse, integration=20,000 times, relaxation delay=4 seconds, data point=32K, offset=100 ppm, observation width=250 ppm, measurement temperature=70 deg. C (2) Measurement nucleus=13C (125 MHz), measurement pulse file=single pulse dec.jxp (13C), 45 deg. C pulse, integration=64 times, relaxation delay=5 seconds, data point=32K, observation width=15 ppm, measurement temperature=65 deg. C Method of Measuring Weight Average Molecular Weight The weight average molecular weight of the maleic-acid-modified polyolefin having a polypropylene block in the main chain is determined by measuring a molecular weight distribution of THF-soluble matter thereof using a GPC (gel permeation chromatography) measuring instrument GPC-150C (manufactured by Waters Corporation).

The measurement is conducted using columns (SHODEX KF 801 to 807 manufactured by Showa Denko K.K.) as follows. The columns are stabilized in a heat chamber at 40 degrees C. Tetrahydrofuran (THF) as a solvent is let to flow in the columns at that temperature at a flow rate of 1 milliliter per minute. Next, 0.05 g of a sample is thoroughly dissolved in 5 g of THF and filtered with a pretreatment filter (e.g., a chromatographic disk having a pore size of 0.45 μm, manufactured by KURABO INDUSTRIES LTD.) to prepare a THF solution of the sample having a sample concentration of from 0.05% to 0.6% by mass, and 50 to 200 μl thereof is injected in the measuring instrument.

The weight average molecular weight (Mw) and the number average molecular weight (Mn) of the THF-soluble matter in the sample are determined by comparing the molecular weight distribution of the sample with a calibration curve that has been created with several types of monodisperse polystyrene standard samples. Specifically, the calibration curve shows the relation between the logarithmic values of molecular weights and the number of counts.

The polystyrene standard samples for creating the calibration curve are those having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$, respectively, available from Pressure Chemical Company or Tosoh Corporation. Preferably, about 10 standard polystyrene samples are used. As the detector, a refractive index (RI) detector is used.

Method of Measuring ½ Outflow Temperature

The ½ outflow temperature of the maleic-acid-modified polyolefin having a polypropylene block in the main chain and the ½ outflow temperature of the toner are measured using a flowtester (CFT-500D available from Shimadzu Corporation) as follows. First, 1.0 g of a sample is applied with a load of 1.96 MPa by a plunger while being heated at a temperature rising rate of 6 degrees C./min and extruded from a nozzle having a diameter of 1.0 mm and a length of 1.0 mm. The amount of decent of the plunger in the flowtester is plotted against the temperature to draw a curve on a graph, and a temperature at which half of the sample has been flowed out is defined as the ½ outflow temperature.

Color of Toner

The toner of the present disclosure may contain a colorant. The colorant is not particularly limited, and commonly used colorants can be appropriately selected and used.

Preferred examples of colorants for black toner include carbon black alone, and a mixture of carbon black as a main component with copper phthalocyanine, whose hue and lightness had been adjusted.

Preferred examples of colorants for cyan toner include, but are not limited to, copper phthalocyanine (Pigment Blue 15:3) and a mixture of copper phthalocyanine with aluminum phthalocyanine.

Examples of colorants for magenta toner include, but are not limited to, Pigment Red 53:1, Pigment Red 81, Pigment Red 122, Pigment Red 269, and combinations thereof.

Examples of colorants for yellow toner include, but are not limited to, Pigment Yellow 74, Pigment Yellow 155, Pigment Yellow 180, Pigment Yellow 185, and combinations thereof. Preferred is Pigment Yellow 185 alone or a mixture of Pigment Yellow 185 with Pigment Yellow 74 for chroma and preservability.

As white pigments, titanium dioxide which has been surface-treated with silicon, zirconia, aluminum, polyol, or the like, can be used.

Examples of colorants for green toner include, but are not limited to, Pigment Green 7, which should be used paying attention to safety.

Examples of colorants for blue toner include, but are not limited to, Pigment Blue 15:1 and Pigment Violet 23.

When a base layer (i.e., a layer closest to the recording medium) is formed with toner of the present disclosure and an upper layer is formed thereon with the conventional toner, the conventional toner can also be satisfactorily fixed on a plastic film. When used in this manner, the toner of the present disclosure is preferably white or colorless (i.e., free of colorant) so as not to impair the color of the toner superposed thereon.

Binder Resin

In the present disclosure, the binder resin (resin for fixation) of the toner may contain a conventionally-known resin in combination with the maleic-acid-modified polyolefin having a polypropylene block in the main chain. Examples thereof include, but are not limited to, styrene-based resins (e.g., homopolymers and copolymers comprising styrene or a styrene-substituted body) such as polystyrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylate copolymer, styrene-methacrylate copolymer, styrene-methyl α-chloroacrylate copolymer, and styrene-acrylonitrile-acrylate copolymer, as well as epoxy resins, vinyl chloride resins, rosin-modified maleic acid resins, phenol resins, polyethylene resins, polypropylene resins, petroleum resins, polyurethane resins, ketone resins, ethylene-ethyl acrylate copolymer, xylene resins, and polyvinyl butyrate resins. The production method of these resins is also not particularly limited, and any of bulk polymerization, solution polymerization, emulsion polymerization, and suspension polymerization can be employed.

In the present disclosure, the binder resin (resin for fixation) preferably includes a polyester resin. More preferably, the binder resin includes a polyester resin as a main component. Polyester resin is fixable at lower temperatures compared with other resins while maintaining heat-resistant storage stability. Therefore, polyester resin is suitable for the binder resin of the present disclosure.

The polyester resin used in the present disclosure is obtained by polycondensation of an alcohol with a carboxylic acid.

Specific examples of the alcohol include, but are not limited to, glycols such as ethylene glycol, diethylene glycol, triethylene glycol, and propylene glycol, etherified bisphenols such as 1,4-bis(hydroxymethyl)cyclohexane and bisphenol A, other divalent alcohol monomers, and trivalent or higher polyvalent alcohol monomers.

Specific examples of the carboxylic acid include, but are not limited to, divalent organic acid monomers such as maleic acid, fumaric acid, phthalic acid, isophthalic acid, terephthalic acid, succinic acid, and malonic acid, and trivalent or higher polyvalent carboxylic acid monomers such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, and 1,2,7,8-octanetetracarboxylic acid.

Preferably, the polyester resin has a glass transition temperature (Tg) of from 50 to 75 degrees C.

Charge Controlling Agent

The toner of the present disclosure may contain a charge controlling agent.

Examples of the charge controlling agent include, but are not limited to: nigrosine and modified products with fatty acid metal salts; onium salts such as phosphonium salt and lake pigments thereof; triphenylmethane dyes and lake pigments thereof; metal salts of higher fatty acids; diorganotin oxides such as dibutyltin oxide, dioctyltin oxide, and dicyclohexyltin oxide; diorganotin borates such as dibutyltin borate, dioctyltin borate, and dicyclohexyltin borate; organometallic complexes, chelate compounds, monoazo metal complexes, acetylacetone metal complexes, and metal complexes of aromatic hydroxycarboxylic acids and aromatic dicarboxylic acids; quaternary ammonium salts; aromatic hydroxycarboxylic acids and aromatic mono- and polycarboxylic acids and metal salts, anhydrides, and esters thereof; and phenol derivatives such as bisphenols. Each of these materials can be used alone or in combination with others.

When the charge controlling agent is contained inside the toner, the amount thereof is preferably from 0.1 to 10 parts by mass based on 100 parts by mass of the binder resin. To prevent undesirable coloring of the toner, a transparent material is preferably selected for the charge controlling agent except for the case of black toner.

Inorganic Particles as External Additives

Examples of inorganic particles as external additives include, but are not limited to, silica, alumina, titanium oxide, barium titanate, magnesium titanate, calcium titanate, strontium titanate, zinc oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride. Among these, silica, alumina, and titanium oxide are particularly preferred.

The inorganic particles may be those treated with a surface treatment agent such as a hydrophobizing agent. Preferred examples of the hydrophobizing agent include, but are not limited to, silane coupling agents, silylation agents, silane coupling agents having a fluorinated alkyl group, organic titanate coupling agents, and aluminum coupling agents. Also, silicone oils are also effective as the hydrophobizing agent.

The primary particles of the inorganic particles preferably have an average particle diameter of from 5 to 500 nm, more preferably from 5 to 200 nm. When the average particle diameter is 5 nm or more, agglomeration of the inorganic particles hardly occurs, and the inorganic particles are uniformly dispersed in the toner. When the average particle diameter is 500 nm or less, heat-resistant storage stability is improved due to a filler effect. Here, the average particle diameter is directly determined from a photograph of particles obtained with a transmission electron microscope. Preferably, the average particle diameter is the average value of long diameters of at least 100 or more particles observed.

Two-component Developer

The toner of the present disclosure may be mixed with a carrier to provide a two-component developer, which is used for an electrophotographic image forming method employing a two-component developing system.

When a two-component developing system is employed, fine particles of a magnetic material can be used as a magnetic carrier. Specific examples of the magnetic materials include, but are not limited to: magnetites; spinel ferrites containing gamma iron oxide; spinel ferrites containing at least one metal (e.g., Mn, Ni, Zn, Mg, and Cu) other than iron; magnetoplumbite-type ferrites such as barium ferrite; and particulate iron or alloy having an oxidized layer on its surface. The magnetic material may be in any of granular, spherical, or needle-like shape. When high magnetization is required, ferromagnetic fine particles, such as iron, are preferably used. For chemical stability, magnetites, spinel ferrites containing gamma iron oxide, and magnetoplumbite-type ferrites such as barium ferrite are preferred.

Specific preferred examples thereof include, but are not limited to, commercially-available products such as MFL-35S and MFL-35HS (available from Powdertech Co., Ltd.); and DFC-400M, DFC-410M, and SM-350NV (available from Dowa IP Creation Co., Ltd.).

A resin carrier may also be used which has a desired magnetization by containing an appropriate type of magnetic fine particles in an appropriate amount. Such a resin carrier preferably has a magnetization strength of from 30 to 150 emu/g at 1,000 oersted. Such a resin carrier may be produced by spraying a melt-kneaded product of magnetic fine particles with an insulating binder resin by a spray dryer, or dispersing magnetic fine particles in a condensation-type binder resin by reacting/curing its monomer or prepolymer in an aqueous medium in the presence of magnetic fine particles.

Chargeability of the magnetic carrier may be controlled by fixedly adhering positively-chargeable or negatively-chargeable fine particles or conductive fine particles to the surface of the magnetic carrier, or coating the magnetic carrier with a resin.

Examples of the surface coating resin include silicone resin, acrylic resin, epoxy resin, and fluorine-based resin. These resins may contain positively-chargeable or negatively-chargeable fine particles or conductive fine particles. Among these resins, silicone resin and acrylic resin are preferred.

Preferably, a mass ratio of the carrier in the developer accommodated in a developing device is 85% by mass or higher but less than 98% by mass. When the mass ratio is 85% by mass or higher, the toner is prevented from scattering from the developing device, thereby preventing the occurrence of defective images. When the mass ratio of the carrier in the developer is less than 98% by mass, an excessive increase of the charge amount of the toner and shortage of the toner to be supplied can be prevented, thereby effectively preventing a decrease of image density and the occurrence of defective images.

Method of Manufacturing Toner

The toner according to an embodiment of the present invention may be prepared as follows. First, a binder resin, a colorant, and a release agent, optionally together with a charge controlling agent, are well mixed by a mixer such as HENSCHEL MIXER and SUPER MIXER. The mixture is then melt-kneaded by a heat melt kneader such as a heat roll, a kneader, and an extruder, so that the materials are thoroughly mixed. The kneaded mixture is cooled to solidify, then pulverized into fine particles, and the fine particles are classified by size to obtain a toner. The pulverizing process may be of a jet mill process in which a high-speed airflow incorporates toner particles to let the toner particles collide with a collision plate and be pulverized by the collision energy, an inter-particle collision process which lets toner particles collide with each other in an airflow, or a mechanical pulverizing process in which toner particles are supplied to a narrow gap formed with a rotor rotating at a high speed to be pulverized.

The toner according to an embodiment of the present invention may also be prepared by a dissolution suspension method. In this method, an oil phase is dispersed in an aqueous medium. Here, the oil phase comprises an organic solvent and toner materials dissolved or dispersed therein. After a reaction for forming a resin is conducted, removal of the solvent, filtration, washing, and drying are conducted, thus obtaining toner base particles. Image Forming Apparatus and Image Forming Method Next, an image forming apparatus and an image forming method according to some embodiments of the present invention are described in detail below.

An image forming apparatus according to an embodiment of the present invention includes: an electrostatic latent image bearer; a charger configured to form an electrostatic latent image on the electrostatic latent image bearer; a developing device accommodating a developer containing the toner according to an embodiment of the present invention, configured to develop the electrostatic latent image formed on the electrostatic latent image bearer with the developer to form a toner image; a transfer device configured to transfer the toner image formed on the electrostatic latent image bearer onto a recording medium; and a fixing device configured to fix the toner image on the recording medium. Preferably, the image forming apparatus includes five developing devices. More preferably, the developing devices respectively accommodate black toner, cyan toner, magenta toner, yellow toner, and the toner according to an embodiment of the present invention. The toner according to an embodiment of the present invention may be of any color but is preferably colorless or white. Hereinafter, a description will be given of a case in which the toner is white. Further, all or part of the black, cyan, magenta, and yellow toners may be the toner according to an embodiment of the present invention.

An image forming method according to an embodiment of the present invention includes: forming an electrostatic latent image on the electrostatic latent image bearer; developing the electrostatic latent image formed on the electrostatic latent image bearer with a developer containing the toner according to an embodiment of the present invention to form a toner image; transferring the toner image formed on the electrostatic latent image bearer onto a recording medium; and fixing the toner image on the recording medium.

FIG. 1 is a schematic diagram illustrating an image forming apparatus according to an embodiment of the present invention. In FIG. 1, the developing device accommodating white toner according to an embodiment of the present invention is omitted. The image forming apparatus illustrated in FIG. 1 includes five toner image forming units 20Y, 20C, 20M, 20K, and 20A accommodating yellow, cyan, magenta, black, and white toners, respectively, arranged in parallel. This image forming apparatus is a tandem image forming apparatus in which toner images of yellow (Y), cyan (C), magenta (M), black (K), and white (A) formed in the five toner image forming units are superimposed to form a full-color image. There is no particular limitation on the arrangement order of the toner image forming units for each color.

The toner image forming units 20Y, 20C, 20M, 20K, and 20A respectively include photoconductor drums 4Y, 4C, 4M, 4K, and 4A as image bearers that are driven to rotate. The image forming apparatus further includes an irradiator 45 configured to irradiate the photoconductor drums 4Y, 4C, 4M, 4K, and 4A with laser light or LED (light emitting diode) light based on image information of each color to form latent images thereon.

An intermediate transfer belt 60 as an intermediate transferor, the surface of which is movable, is disposed so as to face the toner image forming units 20Y, 20C, 20M, 20K, and 20A. Primary transfer rollers 61Y, 61C, 61M, 61K and 61A are disposed facing the respective photoconductor drums 4Y, 4C, 4M, 4K, and 4A via the intermediate transfer belt 60 to transfer the toner images formed on the respective photoconductor drums 4Y, 4C, 4M, 4K, and 4A onto the intermediate transfer belt 60.

The primary transfer rollers 61Y, 61C, 61M, 61K, and 61A sequentially transfer the toner images formed in the toner image forming units 20Y, 20C, 20M, 20K, and 20A, described in detail later, onto the intermediate transfer belt 60 to form a full-color image by superimposition.

A secondary transfer device 65 that collectively transfers the toner images on the intermediate transfer belt 60 onto a transfer sheet is disposed downstream of the primary transfer rollers 61Y, 61C, 61M, 61K, and 61A in the direction of surface movement of the intermediate transfer belt 60. Further, a belt cleaner 66 that removes toner remaining on the surface of the intermediate transfer belt 60 is disposed downstream of the secondary transfer device 65.

A sheet feeder 70 including a sheet tray 71 and a feed roller 72 is disposed on a lower part of the image forming apparatus. The sheet feeder 70 sends out a transfer sheet toward a registration roller pair 73. The registration roller pair 73 sends out the transfer sheet toward the position where the intermediate transfer belt 60 and the secondary transfer device 65 are facing in synchronization with an entry of the toner image to that position. The full-color toner image on the intermediate transfer belt 60 is transferred onto the transfer sheet by the secondary transfer device 65, fixed on the transfer sheet by a fixing device 90, and ejected outside the image forming apparatus.

Figure 2:
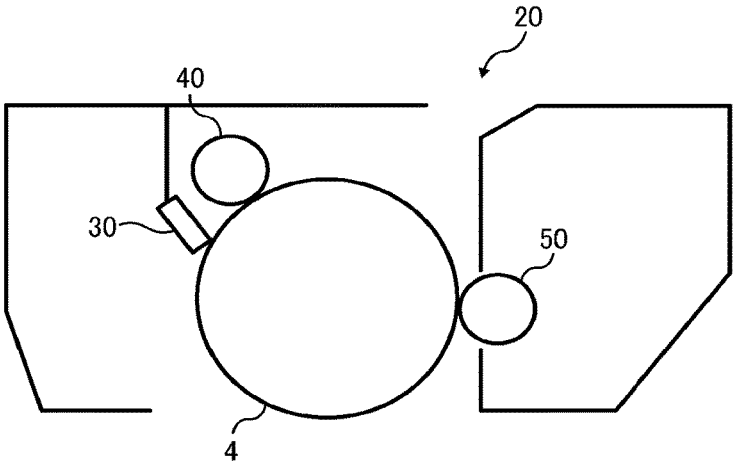
FIG. 2 is a schematic diagram illustrating a main part of an image forming apparatus according to an embodiment of the present invention.

Next, each of the toner image forming units 20Y, 20C, 20M, 20K, and 20A is described in detail below. Each of the toner image forming units 20Y, 20C, 20M, 20K, and 20A has almost the same configuration and operates in the same manner except for accommodating different color toners. Hereinafter, the configuration and operation of each toner image forming unit are described referring to a toner image forming unit 20 from which the suffix Y, C, M, K, or A has been omitted. FIG. 2 is a schematic diagram illustrating a main part of the image forming apparatus.

In the toner image forming unit 20, around a photoconductor drum 4, various devices for performing an electrophotographic process are disposed, such as a charger 40, a developing device 50, and a cleaner 30. The toner image forming unit 20 forms a toner image on the photoconductor drum 4 by a conventional operation. The toner image forming unit 20 may be in the form of a process cartridge that is detachably mounted on the image forming apparatus main body.

Figure 3:
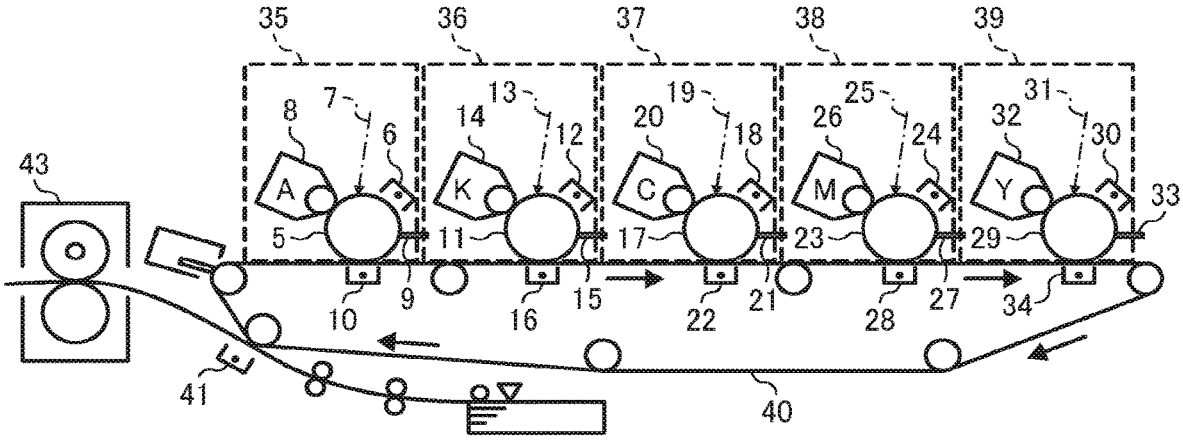
FIG. 3 is a schematic diagram illustrating a main part of an image forming apparatus according to an embodiment of the present invention.

FIG. 3 is a schematic diagram illustrating a main part of an image forming apparatus according to an embodiment of the present invention, including five developing devices. The description of the same parts as those of the above-described image forming apparatus is omitted.

This image apparatus includes photoconductors 5, 11, 17, 23, and 29, around which respective chargers 6, 12, 18, 24, and 30, respective developing devices 8, 14, 20, 26, and 32, respective transfer devices 10, 16, 22, 28, and 34, and respective cleaners 9, 15, 21, 27, 33 are disposed. The photoconductors 5, 11, 17, 23, and 29 are irradiated with exposure light 7, 13, 19, 25, and 31, respectively.

Developing units each include the photoconductor, the charger, the developing device, and the cleaner. Developing units 35, 36, 37, 38, and 39 respectively form images with white toner, black toner, cyan toner, magenta toner, and yellow toner, and the images are transferred onto an intermediate transfer belt 40. The images formed on the intermediate transfer belt 40 are transferred onto a recording medium by a transfer device 41 and fixed thereon by a fixing device 43.

Further, it is preferable that the image formed with the toner according to an embodiment of the present invention be transferred to be closest to the recording medium.

Toner Accommodating Unit

In the present disclosure, a toner accommodating unit refers to a unit having a function of accommodating toner, that is accommodating the toner. The toner accommodating unit may be in the form of, for example, a toner accommodating container, a developing device, or a process cartridge.

The toner accommodating container refers to a container accommodating the toner.

The developing device refers to a device accommodating the toner and having a developing unit configured to develop an electrostatic latent image into a toner image with the toner.

The process cartridge refers to a combined body of an image bearer with a developing unit accommodating the toner, detachably mountable on an image forming apparatus. The process cartridge may further include at least one of a charger, an irradiator, and a cleaner.

When the toner accommodating unit according to an embodiment of the present invention is mounted on the image forming apparatus according to an embodiment of the present invention, an image is formed with the toner according to an embodiment of the present invention, providing a toner image having a high degree of adhesiveness to films, which has not been achieved with conventional process color toners.

Recording Medium

Examples of the recording medium used in the present disclosure include paper media and non-paper media (e.g., plastic films). Preferred are plastic films. Specific examples of the plastic films include, but are not limited to, polyethylene film, polypropylene film, polyethylene terephthalate film, vinyl chloride resin film, polystyrene film, acrylic film, polycarbonate film, polyphenylene sulfide film, fluororesin film, polyetheretherketone film, polyethersulfone film, aramid film, polyimide film, and triacetate film, which are made of different materials. Preferred examples of the recording medium include the above-described recording media whose surfaces are coated with a different material.

EXAMPLES

Having generally described this invention, further understanding can be obtained by reference to certain specific examples which are provided herein for the purpose of illustration only and are not intended to be limiting.

Example 1

Production of Toner 1

Polyester resin EXL-101 (available from Sanyo Chemical Industries, Ltd.): 73 parts by mass Polyester resin RN-290 (available from Kao Corporation): 20 parts by mass Ester wax WEP-5 (available from NOF CORPORATION): 5 parts by mass White pigment (titanium oxide) PF-739 (available from Ishihara Sangyo Kaisha, Ltd.): 65 parts by mass Maleic-acid-modified polyolefin having a polypropylene block in the main chain TOYOTAC-F7 (available from Toyobo Co., Ltd., having a ½ outflow temperature of 125 degrees C., a weight average molecular weight of 90,000, and a maleic acid modification rate of 1.1% by mass): 2 parts by mass The toner raw materials listed above were preliminarily mixed by a HENSCHEL MIXER (FM20B available from NIPPON COKE & ENGINEERING CO., LTD.) and melt-kneaded by a single-shaft kneader (BUSS CO-KNEADER from Buss AG) at a temperature of from 100 to 130 degrees C. The kneaded product was cooled to room temperature and pulverized into coarse particles having a diameter of from 200 to 300 μm by a ROTOPLEX. The coarse particles were further pulverized into fine particles having a weight average particle diameter of 6.2±0.3 μm by a COUNTER JET MILL (100AFG available from Hosokawa Micron Corporation) while appropriately adjusting the pulverization air pressure. The fine particles were classified by size using an air classifier (EJ-LABO available from MATSUBO Corporation) while appropriately adjusting the opening of the louver such that the weight average particle diameter became 7.0±0.2 μm and the ratio of weight average particle diameter to number average particle diameter became 1.20 or less. Thus, toner base particles were prepared. Next, 100 parts of the toner base particles were stir-mixed with additives including 1.0 part of a hydrophobic silica HDK-2000 and 1.0 part of a hydrophobic silica H05TD, both available from Clariant, by a HENSCHEL MIXER. Thus, a toner 1 was prepared. The ½ outflow temperature of the toner was 110 degrees C.

Example 2

Production of Toner 2

Polyester resin EXL-101 (available from Sanyo Chemical Industries, Ltd.): 88 parts by mass Polyester resin RN-290 (available from Kao Corporation): 5 parts by mass Ester wax WEP-5 (available from NOF CORPORATION): 5 parts by mass White pigment (titanium oxide) PF-739 (available from Ishihara Sangyo Kaisha, Ltd.): 65 parts by mass Maleic-acid-modified polyolefin having a polypropylene block in the main chain TOYOTAC-F7 (available from Toyobo Co., Ltd., having a ½ outflow temperature of 125 degrees C., a weight average molecular weight of 90,000, and a maleic acid modification rate of 1.1% by mass): 2 parts by mass A toner 2 was manufactured in the same manner as the toner 1 except that the toner raw materials were replaced with the materials listed above. The ½ outflow temperature of the toner was 101 degrees C.

Comparative Example 1

Production of Toner 3

Polyester resin EXL-101 (available from Sanyo Chemical Industries, Ltd.): 75 parts by mass Polyester resin RN-290 (available from Kao Corporation): 20 parts by mass Ester wax WEP-5 (available from NOF CORPORATION): 5 parts by mass White pigment (titanium oxide) PF-739 (available from Ishihara Sangyo Kaisha, Ltd.): 65 parts by mass A toner 3 was manufactured in the same manner as the toner 1 except that the toner raw materials were replaced with the materials listed above. The ½ outflow temperature of the toner was 114 degrees C.

Example 3

Production of Toner 4

Polyester resin EXL-101 (available from Sanyo Chemical Industries, Ltd.): 73 parts by mass Polyester resin RN-290 (available from Kao Corporation): 20 parts by mass Ester wax WEP-5 (available from NOF CORPORATION): 5 parts by mass White pigment (titanium oxide) PF-739 (available from Ishihara Sangyo Kaisha, Ltd.): 65 parts by mass Maleic-acid-modified polyolefin having a polypropylene block in the main chain TOYOTAC-H3000P (available from Toyobo Co., Ltd., having a ½ outflow temperature of 137 degrees C., a weight average molecular weight of 200,000, and a maleic acid modification rate of 5.5% by mass): 2 parts by mass A toner 4 was manufactured in the same manner as the toner 1 except that the toner raw materials were replaced with the materials listed above. The ½ outflow temperature of the toner was 110 degrees C.

Example 4

Production of Toner 5

Polyester resin EXL-101 (available from Sanyo Chemical Industries, Ltd.): 73 parts by mass Polyester resin RN-290 (available from Kao Corporation): 20 parts by mass Ester wax WEP-5 (available from NOF CORPORATION): 5 parts by mass White pigment (titanium oxide) PF-739 (available from Ishihara Sangyo Kaisha, Ltd.): 65 parts by mass Maleic-acid-modified polyolefin having a polypropylene block in the main chain TOYOTAC-T (available from Toyobo Co., Ltd., having a ½ outflow temperature of 95 degrees C., a weight average molecular weight of 75,000, and a maleic acid modification rate of 1.5% by mass): 2 parts by mass A toner 5 was manufactured in the same manner as the toner 1 except that the toner raw materials were replaced with the materials listed above. The ½ outflow temperature of the toner was 110 degrees C.

Example 5

Production of Toner 6

Polyester resin EXL-101 (available from Sanyo Chemical Industries, Ltd.): 73 parts by mass Polyester resin RN-290 (available from Kao Corporation): 20 parts by mass Ester wax WEP-5 (available from NOF CORPORATION): 5 parts by mass White pigment (titanium oxide) PF-739 (available from Ishihara Sangyo Kaisha, Ltd.): 65 parts by mass Maleic-acid-modified polyolefin having a polypropylene block in the main chain TOYOTAC-KH (available from Toyobo Co., Ltd., having a ½ outflow temperature of 80 degrees C., a weight average molecular weight of 90,000, and a maleic acid modification rate of 1.1% by mass): 2 parts by mass A toner 6 was manufactured in the same manner as the toner 1 except that the toner raw materials were replaced with the materials listed above. The ½ outflow temperature of the toner was 110 degrees C.

Example 6

Production of Toner 7

Polyester resin EXL-101 (available from Sanyo Chemical Industries, Ltd.): 73 parts by mass Polyester resin RN-290 (available from Kao Corporation): 20 parts by mass Paraffin wax HNP-9 (available from Nippon Seiro Co., Ltd.): 5 parts by mass White pigment (titanium oxide) PF-739 (available from Ishihara Sangyo Kaisha, Ltd.): 65 parts by mass Maleic-acid-modified polyolefin having a polypropylene block in the main chain TOYOTAC-F7 (available from Toyobo Co., Ltd., having a ½ outflow temperature of 125 degrees C., a weight average molecular weight of 90,000, and a maleic acid modification rate of 1.1% by mass): 2 parts by mass A toner 7 was manufactured in the same manner as the toner 1 except that the toner raw materials were replaced with the materials listed above. The ½ outflow temperature of the toner was 110 degrees C.

Example 7

Production of Toner 8

Polyester resin EXL-101 (available from Sanyo Chemical Industries, Ltd.): 73 parts by mass Polyester resin RN-290 (available from Kao Corporation): 20 parts by mass Ester wax WEP-5 (available from NOF CORPORATION): 5 parts by mass White pigment (titanium oxide) PF-739 (available from Ishihara Sangyo Kaisha, Ltd.): 65 parts by mass Maleic-acid-modified polyolefin having a polypropylene block in the main chain TOYOTAC-TE (available from Toyobo Co., Ltd., having a ½ outflow temperature of 95 degrees C., a weight average molecular weight of 60,000, and a maleic acid modification rate of 2.0% by mass): 2 parts by mass A toner 8 was manufactured in the same manner as the toner 1 except that the toner raw materials were replaced with the materials listed above. The ½ outflow temperature of the toner was 110 degrees C.

Comparative Example 2

Production of Toner 9

Polyester resin EXL-101 (available from Sanyo Chemical Industries, Ltd.): 73 parts by mass Polyester resin RN-290 (available from Kao Corporation): 20 parts by mass Ester wax WEP-5 (available from NOF CORPORATION): 5 parts by mass White pigment (titanium oxide) PF-739 (available from Ishihara Sangyo Kaisha, Ltd.): 65 parts by mass Maleic-acid-modified polyolefin having a polypropylene block in the main chain UMEX 100TS (available from Sanyo Chemical Industries, Ltd., having a ½ outflow temperature of 136 degrees C. and a weight average molecular weight of 9,000): 2 parts by mass A toner 9 was manufactured in the same manner as the toner 1 except that the toner raw materials were replaced with the materials listed above. The ½ outflow temperature of the toner was 110 degrees C.

Example 8

Production of Toner 10

Polyester resin EXL-101 (available from Sanyo Chemical Industries, Ltd.): 73 parts by mass Polyester resin RN-290 (available from Kao Corporation): 20 parts by mass Polyethylene wax POLYWAX 500 (available from TOYO ADL CORPORATION): 5 parts by mass White pigment (titanium oxide) PF-739 (available from Ishihara Sangyo Kaisha, Ltd.): 65 parts by mass Maleic-acid-modified polyolefin having a polypropylene block in the main chain TOYOTAC-F7 (available from Toyobo Co., Ltd., having a ½ outflow temperature of 125 degrees C., a weight average molecular weight of 90,000, and a maleic acid modification rate of 1.1% by mass): 2 parts by mass A toner 10 was manufactured in the same manner as the toner 1 except that the toner raw materials were replaced with the materials listed above. The ½ outflow temperature of the toner was 110 degrees C.

Example 9

Production of Toner 11

Polyester resin EXL-101 (available from Sanyo Chemical Industries, Ltd.): 93 parts by mass Ester wax WEP-5 (available from NOF CORPORATION): 5 parts by mass White pigment (titanium oxide) PF-739 (available from Ishihara Sangyo Kaisha, Ltd.): 65 parts by mass Maleic-acid-modified polyolefin having a polypropylene block in the main chain TOYOTAC-F7 (available from Toyobo Co., Ltd., having a ½ outflow temperature of 125 degrees C., a weight average molecular weight of 90,000, and a maleic acid modification rate of 1.1% by mass): 2 parts by mass A toner 11 was manufactured in the same manner as the toner 1 except that the toner raw materials were replaced with the materials listed above. The ½ outflow temperature of the toner was 99 degrees C.

Example 10

Production of Toner 12

Polyester resin EXL-101 (available from Sanyo Chemical Industries, Ltd.): 68 parts by mass Polyester resin RN-290 (available from Kao Corporation): 25 parts by mass Ester wax WEP-5 (available from NOF CORPORATION): 5 parts by mass White pigment (titanium oxide) PF-739 (available from Ishihara Sangyo Kaisha, Ltd.): 65 parts by mass Maleic-acid-modified polyolefin having a polypropylene block in the main chain TOYOTAC-F7 (available from Toyobo Co., Ltd., having a ½ outflow temperature of 125 degrees C., a weight average molecular weight of 90,000, and a maleic acid modification rate of 1.1% by mass): 2 parts by mass A toner 12 was manufactured in the same manner as the toner 1 except that the toner raw materials were replaced with the materials listed above. The ½ outflow temperature of the toner was 117 degrees C.

Example 11

Production of Toner 13

Polyester resin EXL-101 (available from Sanyo Chemical Industries, Ltd.): 75 parts by mass Polyester resin RN-290 (available from Kao Corporation): 20 parts by mass Ester wax WEP-5 (available from NOF CORPORATION): 5 parts by mass White pigment (titanium oxide) PF-739 (available from Ishihara Sangyo Kaisha, Ltd.): 65 parts by mass Maleic-acid-modified polyolefin having a polypropylene block in the main chain TOYOTAC-F7 (available from Toyobo Co., Ltd., having a ½ outflow temperature of 125 degrees C., a weight average molecular weight of 90,000, and a maleic acid modification rate of 1.1% by mass): 0.1 parts by mass A toner 13 was manufactured in the same manner as the toner 1 except that the toner raw materials were replaced with the materials listed above. The ½ outflow temperature of the toner was 114 degrees C.

Example 12

Production of Toner 14

Polyester resin EXL-101 (available from Sanyo Chemical Industries, Ltd.): 67 parts by mass Polyester resin RN-290 (available from Kao Corporation): 20 parts by mass Ester wax WEP-5 (available from NOF CORPORATION): 5 parts by mass White pigment (titanium oxide) PF-739 (available from Ishihara Sangyo Kaisha, Ltd.): 65 parts by mass Maleic-acid-modified polyolefin having a polypropylene block in the main chain TOYOTAC-F7 (available from Toyobo Co., Ltd., having a ½ outflow temperature of 125 degrees C., a weight average molecular weight of 90,000, and a maleic acid modification rate of 1.1% by mass): 8 parts by mass A toner 14 was manufactured in the same manner as the toner 1 except that the toner raw materials were replaced with the materials listed above. The ½ outflow temperature of the toner was 111 degrees C.

Note that "TOYOTAC-F7", "TOYOTAC-H3000P", "TOYOTAC-T", "TOYOTAC-KH", and "TOYOTAC-TE" each, used as the maleic-acid-modified polyolefin having a polypropylene block in the main chain, contain a polyethylene block and a polybutene block.

Production of Two-component Developer

Preparation of Carrier

Silicone resin (Organo straight silicone): 100 parts by mass

Toluene: 100 parts by mass

γ-(2-Aminoethyl)aminopropyl trimethoxysilane: 5 parts by mass

Carbon black: 10 parts by mass

The above materials were dispersed by a homomixer for 20 minutes to prepare a coating layer forming liquid. Manganese (Mn) ferrite particles having a weight average particle diameter of 35 μm as core materials were coated with the coating layer forming liquid using a fluidized bed coating device while controlling the temperature inside the fluidized bed to 70 degrees C., followed by drying, so that the coating layer was formed on the surface of the core materials with an average film thickness of 0.20 μm. The core materials having the coating layer were burnt in an electric furnace at 180 degrees C. for 2 hours. Thus, a carrier A was prepared.

Preparation of Two-Component Developer

The toner was uniformly mixed with the carrier A by a TURBULA MIXER (available from Willy A. Bachofen (WAB)) at a revolution of 48 rpm for 5 minutes to be charged. Thus, a two-component developer was prepared. The mixing ratio of the toner to the carrier was 7% by mass, which was equal to the initial toner concentration in the developer in the test machine.

Evaluation Methods

The evaluation results are presented in Table 1. The evaluation methods and conditions were as follows.

Fixed Solid Image Forming Conditions (1) The toners 1 to 14 and two-component developers thereof were each set in the fifth station of RICOH Pro C7200S (manufactured by Ricoh Co., Ltd.). The development and transfer conditions were set by a process controller such that the amount of toner deposition became 0.40 mg/cm$^2$. An unfixed white solid image was formed with each of the toners 1 to 14 on a plastic film (FASSON 2M MET BOPP UVIJ/S7000/1 (SPEC #79631), available from Avery Dennison Corporation).

(2) Next, on the unfixed white solid image, magenta toner mounted on the RICOH Pro C7200S was deposited under the development and transfer conditions set by the process controller such that the amount of toner deposition became 0.40 mg/cm$^2$. Thus, an unfixed solid image was formed in which white and magenta colors were superimposed.

(3) The images were fixed changing the fixing temperature in the range of from 130 to 200 degrees C. in steps of 5 degrees C. by the process controller. The fixing strength of each fixed image was evaluated according to the below-described evaluation method.

The amount of toner deposition here refers to the amount of toner deposited on the plastic film FASSON 2M MET BOPP UVIRS7000/1 (SPEC #79631) after development and transfer.

Fixing Strength Evaluation Method

Figure 4:
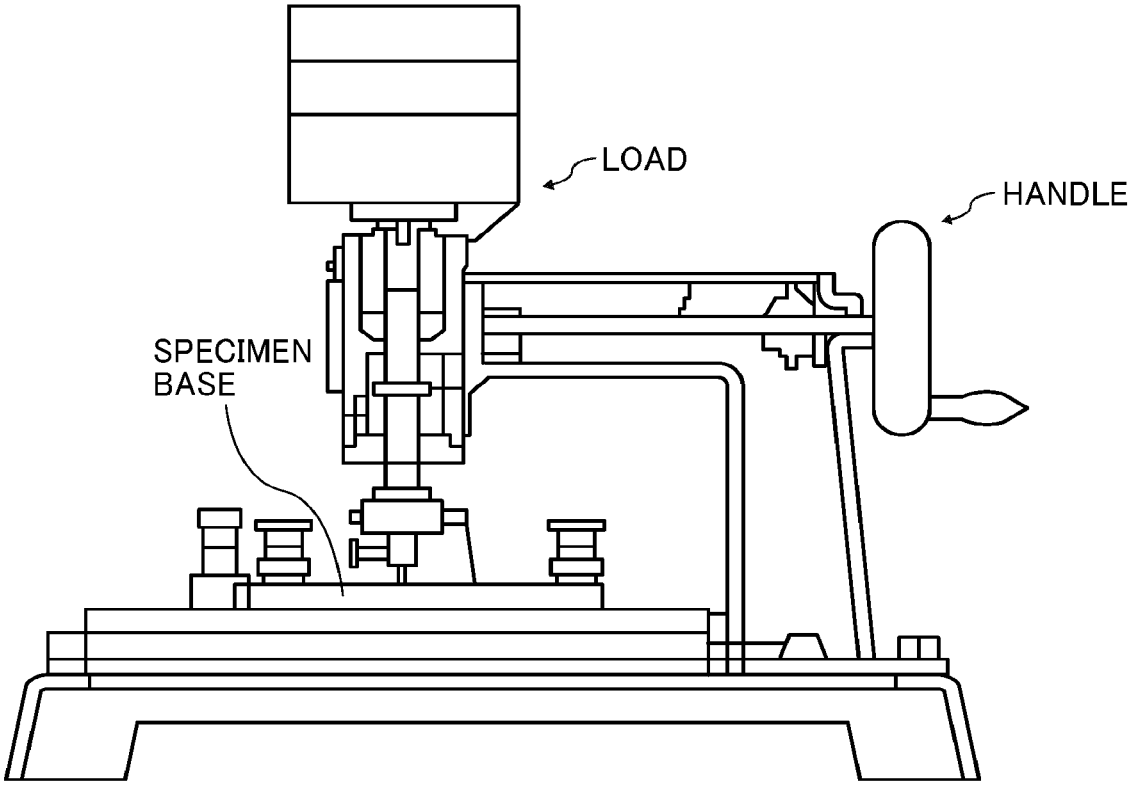
FIG. 4 is an illustration of a drawing tester capable of pressing a needle against a sample, used for an evaluation of fixing strength.

The fixed image was placed on a specimen base of a drawing tester illustrated in FIG. 4, and the needle was pressed against the specimen with application of a load of 50 g. The handle was rotated 5 times in one direction at a speed of about 1 to 2 times/sec. After the drawing test, the image was rubbed strongly with sponge waste cloth or the like about 3 times in a reciprocated manner, and the scraped toner was removed. A case in which the background was not exposed even with the drawing marks was judge to be OK. The temperature at which the result of the drawing test was OK was evaluated based on the following criteria.

A case in which the image was fixed at 170 degrees C. or higher and curling occurred during fixing was judged that releasability was poor. A case in which the toner image was fixed at less than 170 degrees C. without any problem was judged that releasability was excellent.

Evaluation Criteria

A: Fixed at less than 150 degrees C., and no film curling occurred during fixing.

B: Fixed at 150 degrees C. or higher and lower than 170 degrees C., and film curling slightly occurred during fixing.

C: Fixed at 170 degrees C. or higher, and curling occurred at the time of fixing.

Tape Peel Strength

A piece of mending tape (manufactured by Sumitomo 3M Limited) was attached to the obtained fixed image, and a 500-g cylindrical weight (having a diameter of 3 cm) was placed thereon with its bottom face downward, so that the tape sufficiently got adhered to the fixed image. After that, the mending tape was slowly peeled off from the fixed image. The image density of the fixed image before and after the tape had been attached was measured using an image densitometer GRETAG SPM50 (manufactured by Gretag-Macbeth). The measurement was performed at three points in the image portion, and the average value was calculated as the image density. The fixing rate (%) was calculated from the following formula: (image density after peeling/image density before peeling)×100. The temperature at which the fixing rate became 90% or more was defined as the fixing temperature.

Evaluation Criteria

A: Fixed at less than 150 degrees C., and no film curling occurred during fixing.

B: Fixed at 150 degrees C. or higher and lower than 170 degrees C., and film curling slightly occurred during fixing.

C: Fixed at 170 degrees C. or higher, and curling occurred at the time of fixing.

The formulation and evaluation results are presented in Table 1.

TABLE 1

| | | Ex. 1 | Ex. 2 | Comp. Ex. 1 | Ex. 3 | Ex. 4 | Ex. 5 | Ex. 6 | Ex. 7 | Comp. Ex. 2 | Ex. 8 | Ex. 9 | Ex. 10 | Ex. 11 | Ex. 12 |
|---|---|---|---|---|---|---|---|---|---|---|---|---|---|---|---|
| | Toner Production Example | 1 | 2 | 3 | 4 | 5 | 6 | 7 | 8 | 9 | 10 | 11 | 12 | 13 | 14 |
| Binder | Polyester Resin (EXL-101) | 73 | 88 | 75 | 73 | 73 | 73 | 73 | 73 | 73 | 73 | 93 | 68 | 75 | 67 |
| Resin | Polyester Resin (RN-290) | 20 | 5 | 20 | 20 | 20 | 20 | 20 | 20 | 20 | 20 | 0 | 25 | 20 | 20 |
| | TOYOTAC-F7 (Mw: 90,000) | 2 | 2 | 0 | | | | 2 | | | 2 | 2 | 2 | 0.1 | 8 |
| | TOYOTAC-H3000P (Mw: 200,000) | | | | 2 | | | | | | | | | | |
| | TOYOTAC-T (Mw: 75,000) | | | | | 2 | | | | | | | | | |
| | TOYOTAC-KH (Mw: 90,000) | | | | | | 2 | | | | | | | | |
| | TOYOTAC-TE (Mw: 60,000) | | | | | | | | 2 | | | | | | |
| Release | UMEX 100TS (Mw: 9,000) | | | | | | | | | 2 | | | | | |
| Agent | Ester Wax (WEP-5) | 5 | 5 | 5 | 5 | 5 | 5 | | 5 | 5 | | 5 | 5 | 5 | 5 |
| | Paraffin Wax (HNP-9) | | | | | | | 5 | | | | | | | |
| | Polyethylene Wax (POLYWAX 500) | | | | | | | | | | 5 | | | | |
| Colorant | Titanium Oxide (PF-739) | 65 | 65 | 65 | 65 | 65 | 65 | 65 | 65 | 65 | 65 | 65 | 65 | 65 | 65 |
| Evaluation | Fixing Strength | A | A | C | B | A | B | B | A | B | B | B | B | A | A |
| | Tape Peel Strength | A | A | C | B | B | B | B | B | C | B | B | B | A | A |

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. An image forming method, comprising:

forming an electrostatic latent image on an electrostatic latent image bearer;

developing the electrostatic latent image formed on the electrostatic latent image bearer with a developer containing a toner comprising a maleic-acid-modified polyolefin having a polypropylene block in a main chain and having a weight average molecular weight of 60,000 or more and having a maleic acid modification rate of from 0.5% to 8.0% by mass and wherein the toner is colorless or white, to form a first toner image;

transferring the first toner image formed on the electrostatic latent image onto a recording medium which comprises a plastic film; and fixing the first toner image on the recording medium, wherein the first toner image formed in the developing is closer to the recording medium than any other toner images that are present, and wherein the method further comprises forming a second toner image with any of a black toner, cyan toner, magenta toner, or yellow toner on the first toner image.

2. The image forming method according to claim 1, wherein the weight average molecular weight is 80,000 or more.

3. The image forming method according to claim 1, wherein the maleic-acid-modified polyolefin has a ½ outflow temperature of from 95 to 150 degrees C.

4. The image forming method according to claim 1, wherein the toner further comprises an ester wax.

5. The image forming method according to claim 1, wherein the toner has a ½ outflow temperature of from 100 to 115 degrees C.

6. The image forming method according to claim 1, wherein the toner comprises 0.1 to 8.0% by mass of the maleic-acid modified polyolefin.

7. The image forming method according to claim 1, wherein the weight average molecular weight is from 80,000 to 100,000.

8. The image forming method according to claim 4, wherein the toner comprises 0.1% to 8.0% by mass of the ester wax.

9. The image forming method according to claim 1, wherein the maleic-acid-modified polyolefin having a polypropylene block also contain a polyethylene block and a polybutene block.

10. The image forming method according to claim 9, wherein the toner further comprises a polyester resin.

11. The image forming method according to claim 9, wherein the toner further comprises a white pigment.

12. The image forming method according to claim 9, having a maleic acid modification rate of from 1.1% to 5.5% by mass.

13. The image forming method according to claim 9, wherein the toner comprises 0.1% to 8.0% by mass of the ester wax and 0.1 to 8.0% by mass of the maleic-acid modified polyolefin.

14. The image forming method according to claim 1, wherein the recording medium is a plastic film selected from the group consisting of polyethylene film, polypropylene film, polyethylene terephthalate film, vinyl chloride resin film, polystyrene film, acrylic film, polycarbonate film, polyphenylene sulfide film, fluororesin film, polyetheretherketone film, polyethersulfone film, aramid film, polyimide film, and triacetate film.

15. The method according to claim 1, wherein the maleic-acid-modified polyolefin having a polypropylene block in the main chain exudes to an interface between the plastic film and the toner, achieving the fixing.

* * * * *